US006779477B2

(12) United States Patent
Lockwood

(10) Patent No.: US 6,779,477 B2
(45) Date of Patent: Aug. 24, 2004

(54) COCKPIT SYSTEMS AND METHODS FOR KAYAKS

(76) Inventor: John B. Lockwood, 1510 Jefferson St., Port Townsend, WA (US) 98368

( * ) Notice: Subject to any disclaimer, the term of this patent is extended or adjusted under 35 U.S.C. 154(b) by 0 days.

(21) Appl. No.: 10/246,021

(22) Filed: Sep. 17, 2002

(65) Prior Publication Data

US 2003/0051653 A1 Mar. 20, 2003

Related U.S. Application Data

(60) Provisional application No. 60/323,236, filed on Sep. 18, 2001.

(51) Int. Cl.[7] ..... B63B 35/71
(52) U.S. Cl. ..... 114/347
(58) Field of Search ..... 114/347, 354

(56) References Cited

U.S. PATENT DOCUMENTS

| | | | | |
|---|---|---|---|---|
| 1,649,311 A | * | 11/1927 | Kaechele et al. | 114/354 |
| 1,792,140 A | * | 2/1931 | Brock | 114/361 |
| 1,889,368 A | * | 11/1932 | Messenger | 114/347 |
| 2,999,253 A | * | 9/1961 | Lewis | 114/347 |
| D233,424 S | | 10/1974 | Lettman | |
| D234,397 S | | 2/1975 | Eriksen | |
| 4,031,580 A | * | 6/1977 | Neumann et al. | 114/347 |
| 4,229,850 A | | 10/1980 | Arcouette | |
| 4,480,579 A | | 11/1984 | Masters | |
| D358,573 S | | 5/1995 | Lockwood | |
| D370,454 S | | 6/1996 | Lockwood | |
| D397,668 S | | 9/1998 | Lincoln | |
| D418,801 S | | 1/2000 | Lockwood | |
| D418,802 S | | 1/2000 | Lockwood | |
| D419,128 S | | 1/2000 | Lockwood | |

OTHER PUBLICATIONS

Pygmy Boat Co. sales brochure printed approx. 1993.

Printings from U.S. National Museum, p. 196, ALEUTIAN KAYAK, Unalaska, 1894; Kayak from Russian Siberia, 1962; p. 198, Norton Sound Kayak, Alaska, 1889; p. 201, Kotzebue Sound Kayak, Point Barrow Kayak, Mackenzie Delta Kayak, 1888, p. 210, Northwestern Greenland Kayak, 1883, Southwestern Greenland Kayak, 1921.

CountryWays® Inc. boat kits, Kayak Kits, "Scandian Single", dated Oct. 11, 1979 by Examiner Kay H. Chin (copy in D12/302).

* cited by examiner

*Primary Examiner*—Sherman Basinger
(74) *Attorney, Agent, or Firm*—Michael R. Schacht; Schacht Law Office, Inc.

(57) ABSTRACT

A cockpit system for a kayak having a deck and a cockpit opening defined in the deck. The cockpit system comprises bow and stern deck portions, a coaming assembly, and a transition member. The bow and stern deck portions form the deck. The cockpit opening is formed in the bow deck portion. The deck gap region is formed between the bow deck portion and the stern deck portion. The coaming assembly extends around the cockpit opening. The transition member is arranged between the bow deck portion and the stern deck portion. The transition member is sized and dimensioned to fill the deck gap region.

18 Claims, 8 Drawing Sheets

COCKPIT SYSTEMS AND METHODS FOR KAYAKS

RELATED APPLICATIONS

This application claims priority of U.S. Provisional Patent Application Serial No. 60/323,236, which was filed on Sep. 18, 2001.

TECHNICAL FIELD

The present invention relates to cockpit systems and methods for kayaks and, more particularly, to recessed cockpit systems methods adapted to be used on kayaks constructed of, or fabricated based on, discrete wood panels.

BACKGROUND OF THE INVENTION

The present invention relates to wooden kayaks made of wooden panels that are stitched together and glued at the joints, after which the entire kayak is covered inside and out in fiberglass. This construction technique, commonly referred to as "stitch and glue" technique, results in a highly functional and aesthetically pleasing product. Also, while often is used in a factory setting, the stitch and glue technique may be performed by one without significant expertise in woodworking or boat making. Stitch and glue products are thus often sold in kits for final assembly by the end user.

Typically, stitch and glue craft comprise a hull made of at least two hull panels and a deck made of one or more deck panels. The deck panels extend from bow to stern of the kayak, and the deck panel or panels define a cockpit opening approximately midway between the bow and the stern. Typically, the deck panels are flexed during installation to create a curved (one deck panel) or chined (two or more deck panels) convex deck surface. The curved or chined deck yields improved functional and performance characteristics.

However, conventional stitch and glue kayaks using deck panels that are curved or chined and which extend from bow to stern creates an elevated peak in fore and aft portions of a coaming that extends around the cockpit opening. The elevated peak in the fore portion of the coaming is desirable, but the elevated peak at the rear portion of the coaming creates a projection that engages the kayaker's back. This projection can increase discomfort for the kayaker.

The need thus exists for stitch and glue kayak designs that incorporate the improved functional and performance characteristics of a curved or chined deck without resulting in a structure that can cause discomfort to the kayaker.

SUMMARY OF THE INVENTION

A cockpit system for a kayak having a deck and a cockpit opening defined in the deck. The cockpit system comprises bow and stern deck portions, a coaming assembly, and a transition member. The bow and stern deck portions form the deck. The cockpit opening is formed in the bow deck portion. The deck gap region is formed between the bow deck portion and the stern deck portion. The coaming assembly extends around the cockpit opening. The transition member is arranged between the bow deck portion and the stern deck portion. The transition member is sized and dimensioned to fill the deck gap region.

DETAILED DESCRIPTION OF THE INVENTION

Referring initially to FIGS. 1, 2, 8, and 9, depicted at 20*a* and 20*b* therein are first and second embodiments of a cockpit system constructed in accordance with, and embodying, the principles of the present invention. The cockpit system of the first embodiment is identified by the suffix "a", while the cockpit of the second embodiment is identified by the suffix "b".

As shown in FIGS. 1–7, the first exemplary cockpit system 20*a* is optimized for use on a kayak 22*a*. The exemplary kayak 22*a* has chined (multiple panel) bow and stern decks 30*a* and 32*a*. FIGS. 8–14 show that the second exemplary cockpit system 20*b* is optimized for use on a kayak 22*b*. The kayak 22*b* has continuous (single panel) bow and stern decks 30*b* and 32*b*. The principles of the present invention may, however, be applied to other kayaks having different deck configurations. Each of the kayaks 22*a* and 22*b* defines a cockpit opening 34.

The cockpit systems 20*a* and 20*b* each comprise a coaming assembly 40 and a transition member 42*a,b*. The coaming assembly 40 extends around the cockpit opening 34. The transition members 42*a* and 42*b* are arranged behind the coaming assemblies 40*a* and 40*b*, respectively.

Figure 1:
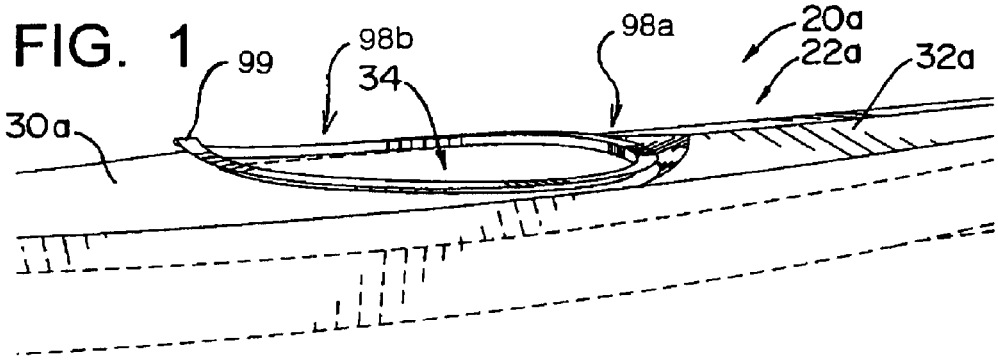
FIGS. 1 and 2 are perspective views of a first embodiment of a cockpit system of the present invention.
Figure 2:
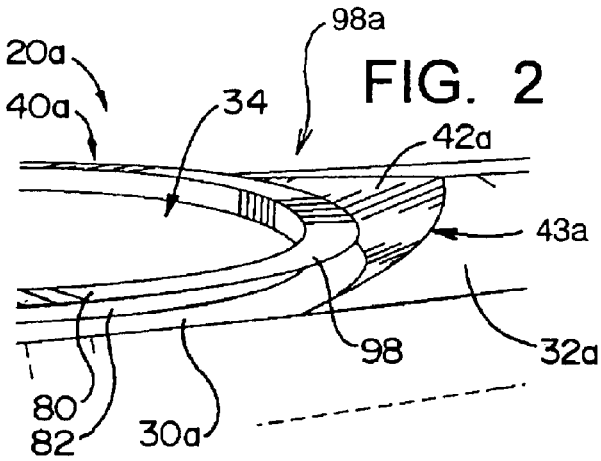
Figure 3:
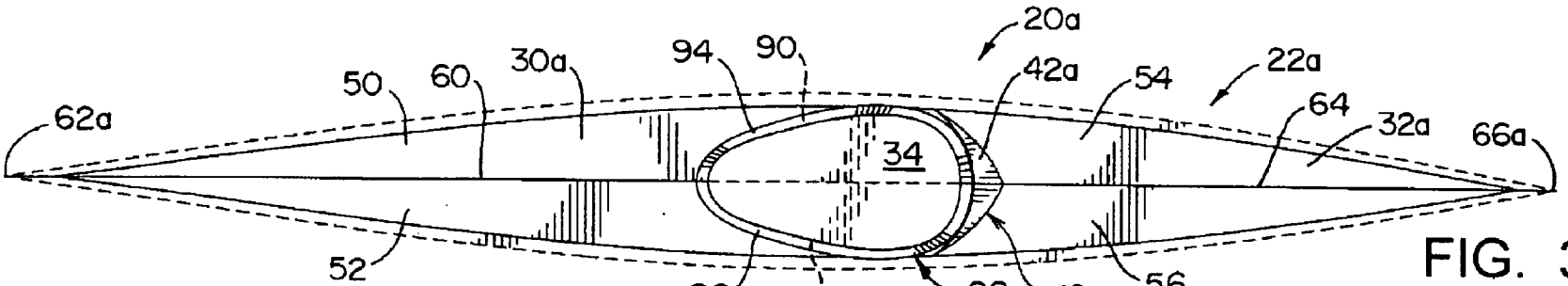
FIG. 3 is a top plan view of a kayak incorporating the cockpit system of FIGS. 1 and 2.
Figure 4:
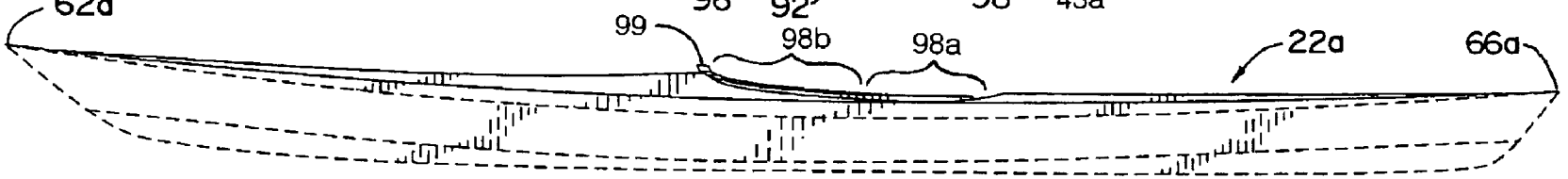
FIG. 4 is a side elevation view of the kayak of FIG. 3.
Figure 5:
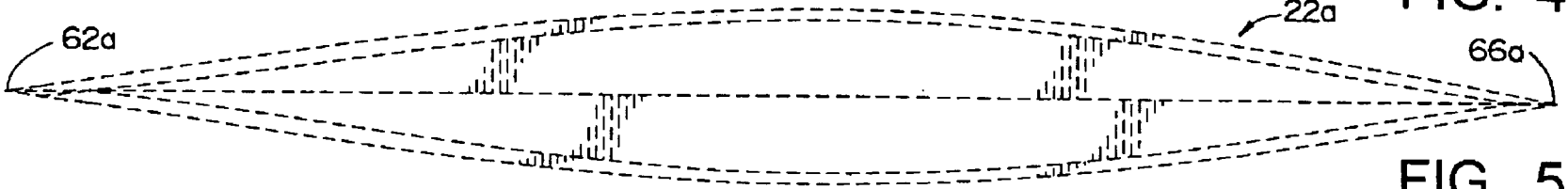
FIG. 5 is a bottom plan view of the kayak of FIG. 3.
Figure 6:
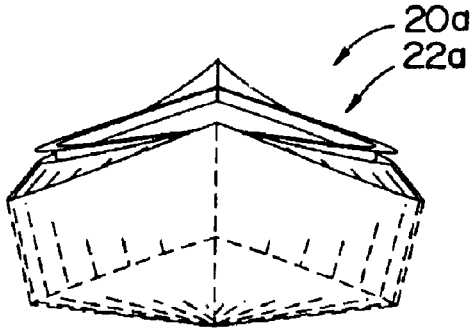
FIG. 6 is a rear end view of the kayak of FIG. 3.
Figure 7:
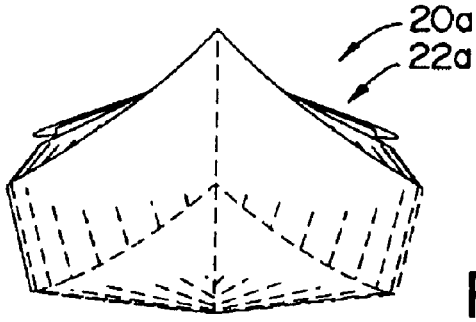
FIG. 7 is a front end view of the kayak of FIG. 3.
Figure 8:
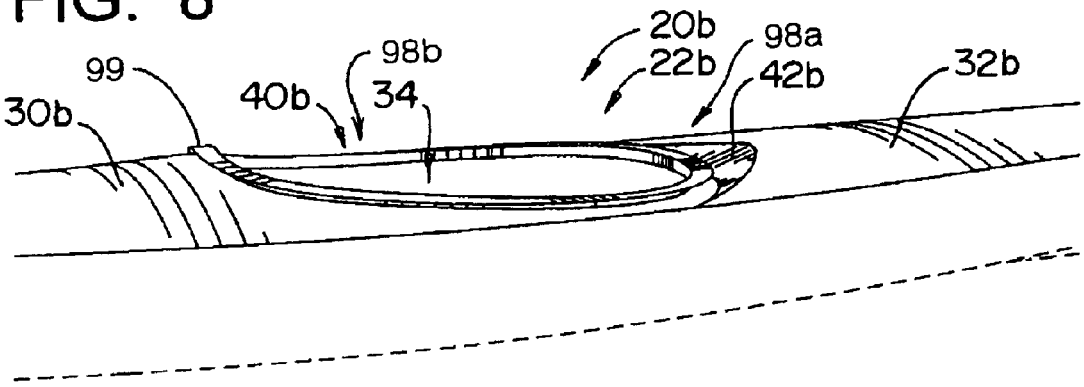
FIGS. 8 and 9 are perspective views of a second embodiment of a cockpit system of the present invention.
Figure 9:
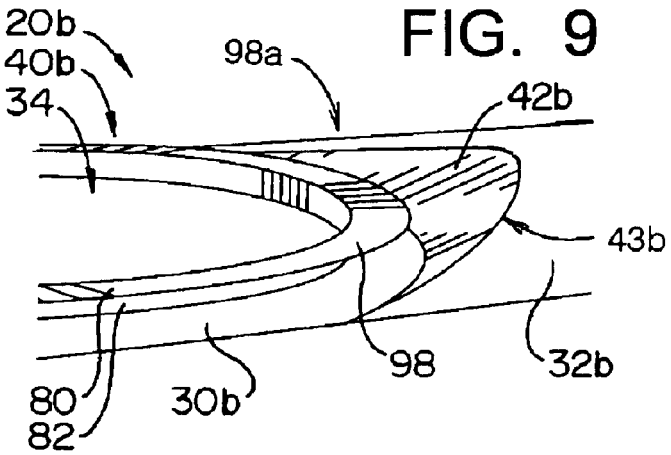
Figure 15:
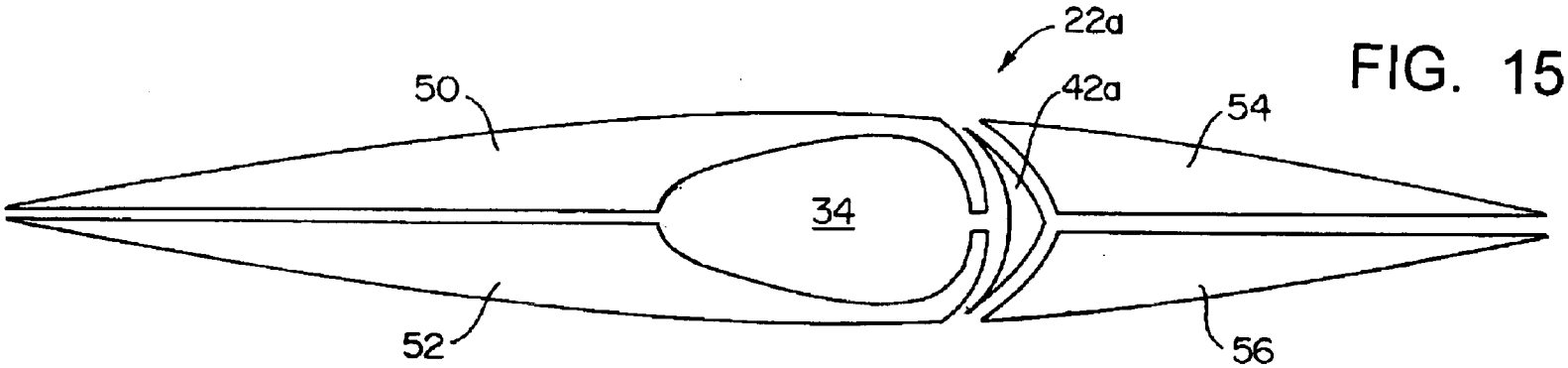
FIG. 15 is an exploded view depicting several panels that are joined together to form the kayak of FIG. 3.

Referring initially to the first exemplary cockpit system 20*a*, the bow and stern deck portions 30*a* and 32*a* are assemblies formed by first and second bow deck panels 50 and 52 and first and second stern deck panels 54 and 56 (FIG. 15). As shown in FIG. 3, the juncture between the panels 50 and 52 forms a bow chine or ridge 60 extending along the bow deck 30*a* between a bow 62*a* of the kayak 22*a* and the cockpit opening 34. FIG. 3 also shows that the juncture between the panels 54 and 56 forms a stern chine or ridge 64 extending between the cockpit opening 34 and a stern 66*a* of the kayak 22*a*.

Figure 10:
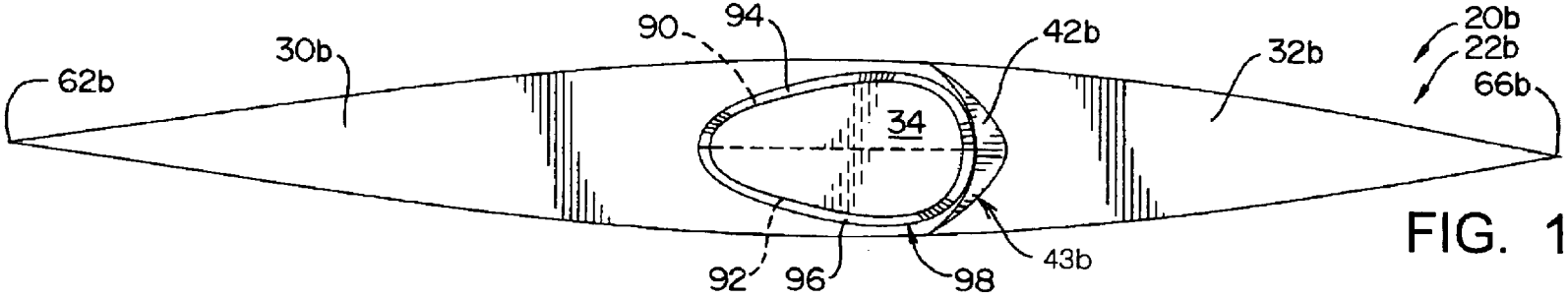
FIG. 10 is a top plan view of a kayak incorporating the cockpit system of FIGS. 8 and 9.
Figure 11:
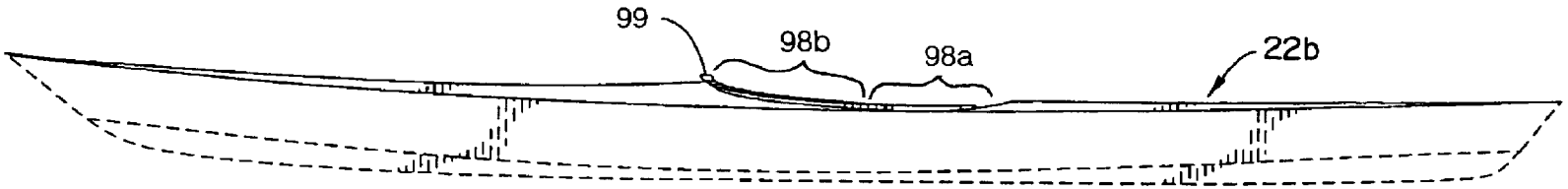
FIG. 11 is a side elevation view of the kayak of of FIG. 10.
Figure 12:
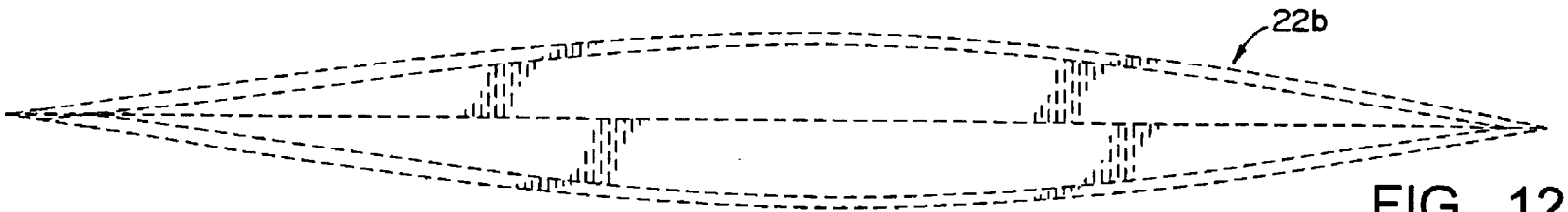
FIG. 12 is a bottom plan view of the kayak of FIG. 10.
Figure 13:
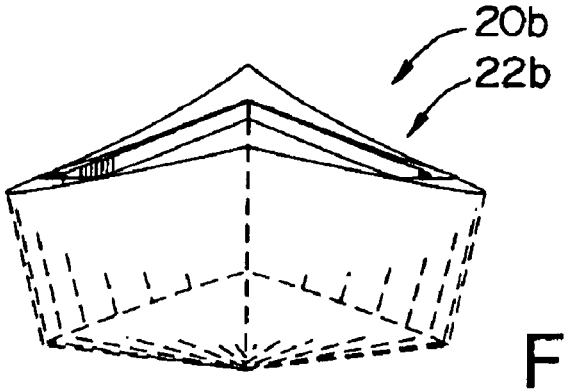
FIG. 13 is a rear end view of the kayak of FIG. 10.
Figure 14:
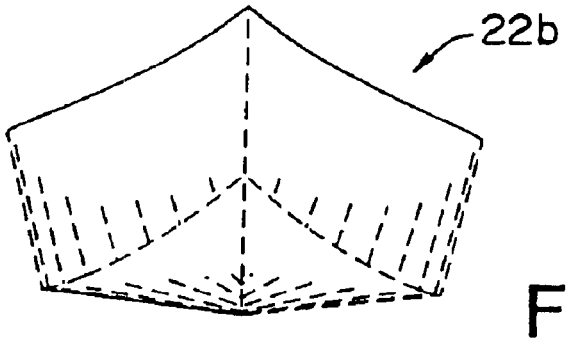
FIG. 14 is a front end view of the kayak of FIG. 10.
Figure 16:
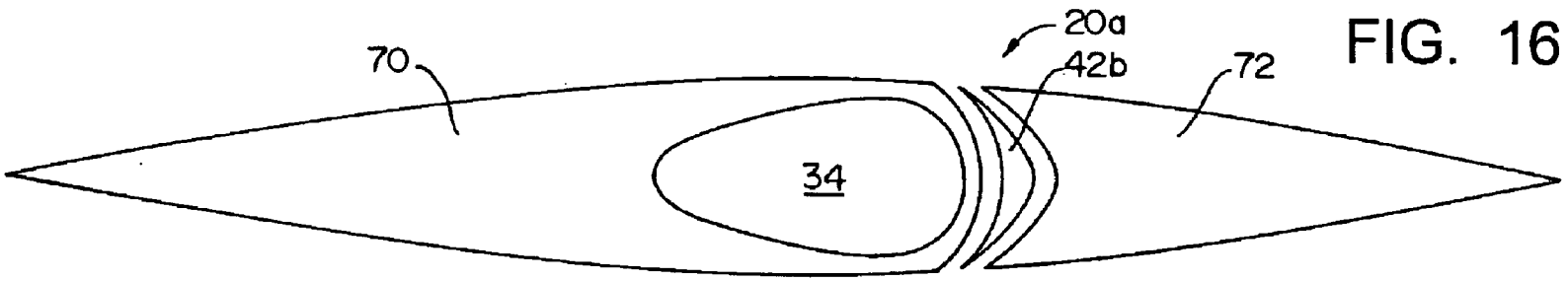
FIG. 16 is an exploded view depicting several panels that are joined together to form the kayak of FIG. 10.
Figure 17:
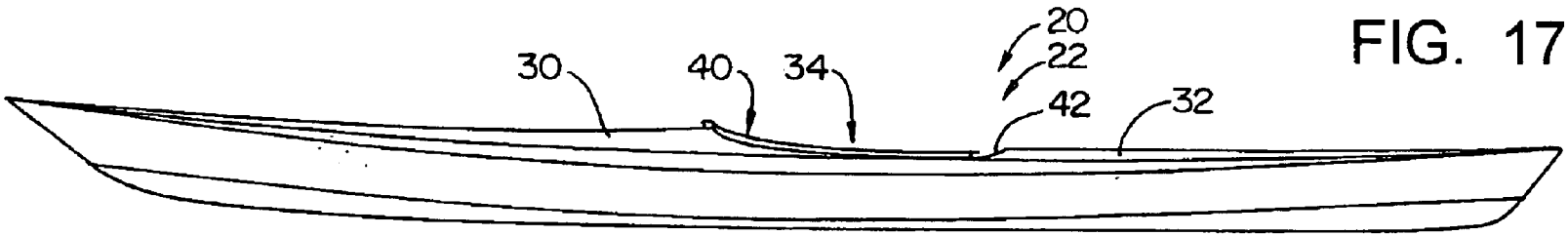
FIG. 17 is an side elevation cutaway view taken along lines 17—17 in FIGS. 3 and 10.
Figure 18:
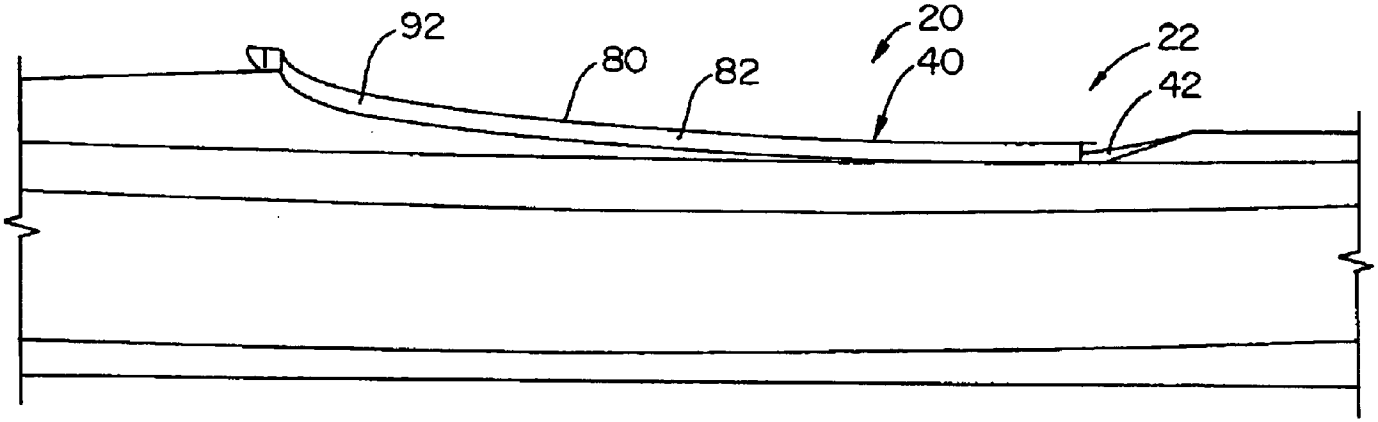
FIG. 18 is an enlarged view of the kayaks as depicted in FIG. 17.

In contrast, FIG. 16 shows that the bow and stern deck portions 30*b* and 32*b* are each formed by a single bow panel 70 and stern panel 72, respectively; as perhaps best shown in FIG. 10, the panels 70 and 72 do not define a chine or ridge like the chines 60 and 64 of the kayak 22*a*. The present invention may thus be used in a kayak having zero, one, or more deck chines as will be described in further detail below.

At least one cockpit opening 34 is formed in each of the bow deck portions 30*a* and 30*b*. The coaming assembly 40 comprises an upper coaming member 80 and a lower coaming member 82. Typically, but not necessarily, as shown in FIGS. 3, 10, 17, and 18, the coaming members 80 and 82 are formed by symmetrical lower coaming panels 90 and 92 and upper coaming panels 94 and 96, respectively.

In the exemplary kayak 22*a*, the lower coaming panels 90 and 92 are secured to the first and second bow deck panels 50 and 52, respectively. In the exemplary kayak 22*b*, the lower coaming panels 90 and 92 are both secured to the bow panel 70. In either case, the upper coaming panels 94 and 96 are rigidly attached to the lower coaming panels 90 and 92, respectively. The upper coaming panels 94 and 96 extend outwardly relative to the cockpit opening 34 to form a flange 98 that extends around the entire cockpit opening 34.

The transition members 42*a* and 42*b* allow the bow deck portions 30*a,b* and stern deck portions 32*a,b* to have different shapes or curvatures and to be at different horizontal levels immediately behind the cockpit opening 34. Generally speaking, the exact shape of the transition members 42 is not critical, but the transition members 42*a* and 42*b* are both cut to fit a deck gap region 43*a* or 43*b* that would otherwise result from the discontinuous shapes and horizontal levels at the juncture of the bow and stern decks 30 and 32. In particular, as indicated in FIGS. 2, 3, 9, and 10 the deck gap regions 43*a* and 43*b* are three-dimensional regions that can be filled by the transition members 42*a* and 42*b*. Using conventional stitch and glue techniques, the transition member 42*a* and 42*b* are flat panels that can be flexed or curved during installation to fill the deck gap regions 43*a*, 43*b*.

The discontinuous deck portions 30 and 32 allow a peaked or chined deck (deck 32*a*) or curved deck (deck 32*b*) to be used while still yielding a substantially planar aft portion 98*a* of the flange 98 at the rear of the cockpit opening 34. In particular, as shown in FIGS. 1, 4, 8, and 11, the aft portion 98*a* of the flange 98 is substantially planar while a forward portion 98*b* of the flange 98 defines a flange peak 99. The planar aft portion 98*a* of the flange 98 allows the kayaker to lean back against the coaming assembly 40 without being jabbed or poked in the lower back by a pointed or peaked structure that would otherwise result from the chined stern deck 32*a* or curved stern deck 32*b*.

The exemplary kayaks 22*a* and 22*b* are typically constructed of a conventional technique referred to in the industry as "stitch and glue". Using conventional stitch and glue techniques, discrete precut panels of marine plywood are stitched together and then glued. The stitches are removed when the glue hardens, and fiberglass is laid over the inner and outer surface of the resulting structure. The cockpit system 20 of the present invention allows the creation of a coaming assembly 40 defining a flange that is substantially flat at the rear of the cockpit opening 34 using the conventional stitch and glue process.

In addition, the stitch and glue process is often used to make plugs for other manufacturing techniques such as all fiberglass kayaks or molded kayaks. The present invention may be used to make a plug or mold appropriate for use by other manufacturing techniques. The resulting end product may thus be a molded plastic or fiberglass kayak using the cockpit system 20 in addition to a more conventional stitch and glue cockpit system.

The present invention may be implemented in forms other than those described above.

I claim:

1. A cockpit system for a kayak having a deck and a cockpit opening defined in the deck, the cockpit system comprising:

bow and stern deck portions forming the deck, where the cockpit opening is formed in the bow deck portion, and a deck gap region is formed between the bow deck portion and the stern deck portion;

a coaming assembly that extends around the cockpit opening; and a transition member arranged between the bow deck portion and the stern deck portion, where the transition member is sized and dimensioned to fill the deck gap region; wherein the bow deck portion adjacent to the transition member is lower than the stern deck portion adjacent to the transition member under normal use of the kayak.

2. A cockpit system as recited in claim 1, in which the stern deck portion is formed of a single deck panel.

3. A cockpit system as recited in claim 1, in which the bow deck portion is formed of a single deck panel.

4. A cockpit system as recited in claim 1, in which the stern deck portion is formed of a plurality of deck panels.

5. A cockpit system as recited in claim 1, in which the bow deck portion is formed of a plurality of deck panels.

6. A cockpit system as recited in claim 1, in which the coaming assembly defines a flange that extends around the cockpit opening, where an aft portion of the flange adjacent to the transition member is substantially horizontal during normal use.

7. A cockpit system as recited in claim 1, in which the coaming assembly comprises:

a lower coaming portion that is secured to the bow deck portion; and an upper coaming portion that is secured to the lower coaming portion.

8. A cockpit system as recited in claim 7, the upper coaming portion defines a flange that extends around the cockpit opening, where an aft portion of the flange adjacent to the transition member is substantially horizontal during normal use.

9. A cockpit system as recited in claim 1, in which the coaming assembly defines a flange that extends around the cockpit opening, where a forward portion of the flange adjacent to the transition member defines a flange peak.

10. A method of forming a cockpit for a kayak having a deck defining a cockpit opening, the method comprising the steps of:

providing bow and stern deck portions;

forming the cockpit opening in the bow deck portion;

joining the bow and stern deck portions to form the deck such that a deck gap region is formed between the bow deck portion and the stern deck portion, and the bow deck portion adjacent to the deck gap region is lower than the stern deck portion adjacent to the deck gap region under normal use of the kayak;

securing a coaming assembly to the bow deck portion around the cockpit opening;

providing a transition member that is sized and dimensioned to fill the deck gap region; and securing the transition member to the bow deck portion and the stern deck portion to fill the deck gap.

11. A method as recited in claim 10, further comprising the step of forming the stern deck portion from a single deck panel.

12. A method as recited in claim 10, further comprising the step of forming the bow deck portion from a single deck panel.

13. A method as recited in claim 10, further comprising the step of forming the stern deck portion from a plurality of deck panels.

14. The method as recited in claim 10, further comprising the step of forming the bow deck portion from a plurality of deck panels.

15. A method as recited in claim 10, comprising the steps of:

creating a mold incorporating the cockpit; and creating a cockpit of a kayak from the mold.

16. A cockpit system for a kayak having a deck and a cockpit opening defined in the deck, the cockpit system comprising:

at least one bow deck panel forming a bow portion of the deck, where the cockpit opening is formed in the bow portion;

a coaming assembly that extends around the cockpit opening;

at least one stern deck panel forming a stern portion of the deck;

a transition member arranged between the bow deck portion and the stern deck portion, where the transition member is sized and dimensioned to fill a deck gap region formed between the bow deck portion and the stern deck portion; wherein the bow deck panel adjacent to the transition member is lower than the stern deck panel adjacent to the transition member under normal use of the kayak.

17. A cockpit system as recited in claim 16, the coaming assembly defines a flange that extends around the cockpit opening, where an aft portion of the flange adjacent to the transition member is substantially horizontal during normal use.

18. A cockpit system as recited in claim 17, in which a forward portion of the flange adjacent to the transition member defines a flange peak.

* * * * *